United States Patent [19]

Elser

[11] 4,324,384

[45] Apr. 13, 1982

[54] SERVICING STAND FOR THREE WHEELED VEHICLES

[76] Inventor: Kirby W. Elser, 8501 Rumson Dr., Santee, Calif. 92071

[21] Appl. No.: 201,031

[22] Filed: Oct. 29, 1980

[51] Int. Cl.[3] ..... B66F 3/00

[52] U.S. Cl. ..... 254/8 B; 254/94; 254/131

[58] Field of Search ..... 254/8 B, 94, 131; 211/17, 20, 22; 414/447, 426, 428

[56] References Cited

U.S. PATENT DOCUMENTS

| | | | |
|---|---|---|---|
| 1,064,191 | 6/1913 | Deh Bunn | 254/94 |
| 2,463,305 | 3/1949 | Poor et al. | 254/94 |
| 2,555,471 | 6/1951 | Chambers | 254/94 |
| 4,113,235 | 9/1978 | Hartman | 254/131 |
| 4,180,253 | 12/1979 | Ivers et al. | 254/131 |

*Primary Examiner*—Robert C. Watson
*Attorney, Agent, or Firm*—Brown & Martin

[57] ABSTRACT

A servicing stand for three wheeled vehicles of the motorcycle type includes a horizontal base which may be supported by casters and a pair of support brackets pivotally mounted to the rearward and forward ends of the base. Each of the brackets can swing from a retracted position through, and slightly past vertical to an extended position. A spring connected between the remote end of the forward bracket and the base urges the forward bracket toward its extended position. A linkage mechanism operatively couples the lower end of the rearward bracket to a releasable clamp mechanism which is utilized for holding the forward bracket in its collapsed position when the rearward bracket is also in its collapsed position. In this configuration, the servicing stand can be rolled underneath the three wheeled vehicle from behind, between its rear two wheels. A pair of C-shaped members at the upper end of the rearward bracket will then engage the rear axle of the vehicle. Thereafter, rearward pulling of the vehicle relative to the servicing stand will cause the clamping mechanism to release, permitting the forward bracket to swing upwardly until its upper end engages the underside of a portion of the vehicle adjacent its motor. Further rearward pulling of the vehicle relative to the servicing stand will cause the forward and rearward brackets to swing past verticle to their extended positions, raising the vehicle off the ground so that it can be readily serviced or moved around on the mobile stand.

10 Claims, 3 Drawing Figures

SERVICING STAND FOR THREE WHEELED VEHICLES

BACKGROUND OF THE INVENTION

The present invention relates to servicing stands, and more particularly, to a servicing stand for three wheeled vehicles of the motorcycle type.

Recently, a new type of off road vehicle in the form of a three wheeled motorcycle has become popular. Typically, it has three balloon type wheels arranged in tricycle configuration. The rear two wheels are rigidly mounted to opposite ends of a solid axle which is powered by a small displacement engine through a chain drive. Examples of such vehicles are the "HONDA ATC 90" and "HONDA ATC 110" all terrain cycles, and the "YAMAHA TRI MOTO".

It would be desirable when performing maintenance and other types of service on such three wheeled vehicles to have a stand for raising the vehicle to an elevated position so that the wheels are clear of the ground. This would permit the wheels to be readily removed from the vehicle. It would also permit the rear wheels to be freely spun to enable servicing of the chain. Furthermore, the lowermost components of the vehicle could be more easily worked on if more clearance between the vehicle and the ground were provided.

It would also be desirable to have a mobile servicing stand for raising such a three wheeled vehicle off the ground so that it could be easily moved in a confined area such as a garage. Because such vehicles are not normally equipped with a differential in their rear axle, turning them in a confined space is quite difficult. Since such a vehicle normally weighs over 200 pounds, it is a formitable task to move the vehicle by manually carrying it.

U.S. Pat. No. 4,077,607 and German Pat. No. 531,326 disclose servicing racks for two wheeled motorcycles. However these racks are not adapted to fit the configuration of three wheeled vehicles. Also of general interest in this field are U.S. Pat. Nos. 3,863,890 and 3,948,106.

SUMMARY OF THE INVENTION

Accordingly, it is the primary object of the present invention to provide a servicing stand for three wheeled vehicles.

A further object of the present invention is to provide a servicing stand for three wheeled vehicles which is compact and easy to use for raising and supporting such a vehicle into an elevated servicing position.

It is another object of the present invention to provide a servicing stand for three wheeled vehicles which can readily be used to move the vehicle around in a confined area.

Still another object of the present invention is to provide a servicing stand for three wheeled vehicles which can be readily rolled underneath such a vehicle so that a forward support bracket associated with the stand will automatically move into engagement with the underside of the vehicle when a rearward support bracket engages the rear axle of the vehicle.

The present invention provides a servicing stand for three wheeled vehicles of the motorcycle type includes a horizontal base which may be supported by casters and a pair of support brackets pivotally mounted to the rearward and forward ends of the base. Each of the brackets can swing from a retracted position through, and slightly past verticle to an extended position. A spring connected between the remote end of the forward bracket and the base urges the forward bracket toward its extended position. A linkage mechanism operatively couples the lower end of the rearward bracket to a releasable clamp mechanism which is utilized for holding the forward bracket in its collapsed position when the rearward bracket is also in its collapsed position. In this configuration, the servicing stand can be rolled underneath the three wheeled vehicle from behind, between its rear two wheels. A pair of C-shaped members at the upper end of the rearward bracket will then engage the rear axle of the vehicle. Thereafter, rearward pulling of the vehicle relative to the servicing stand will cause the clamping mechanism to release, permitting the forward bracket to swing upwardly until its upper end engages the underside or a portion of the vehicle adjacent its motor. Further rearward pulling of the vehicle relative to the servicing stand will cause the forward and rearward brackets to swing past verticle to their extended positions, raising the vehicle off the ground so that it can be readily serviced or moved around on the mobile stand.

DESCRIPTION OF THE PREFERRED EMBODIMENT

Figures 1, 2, 3:
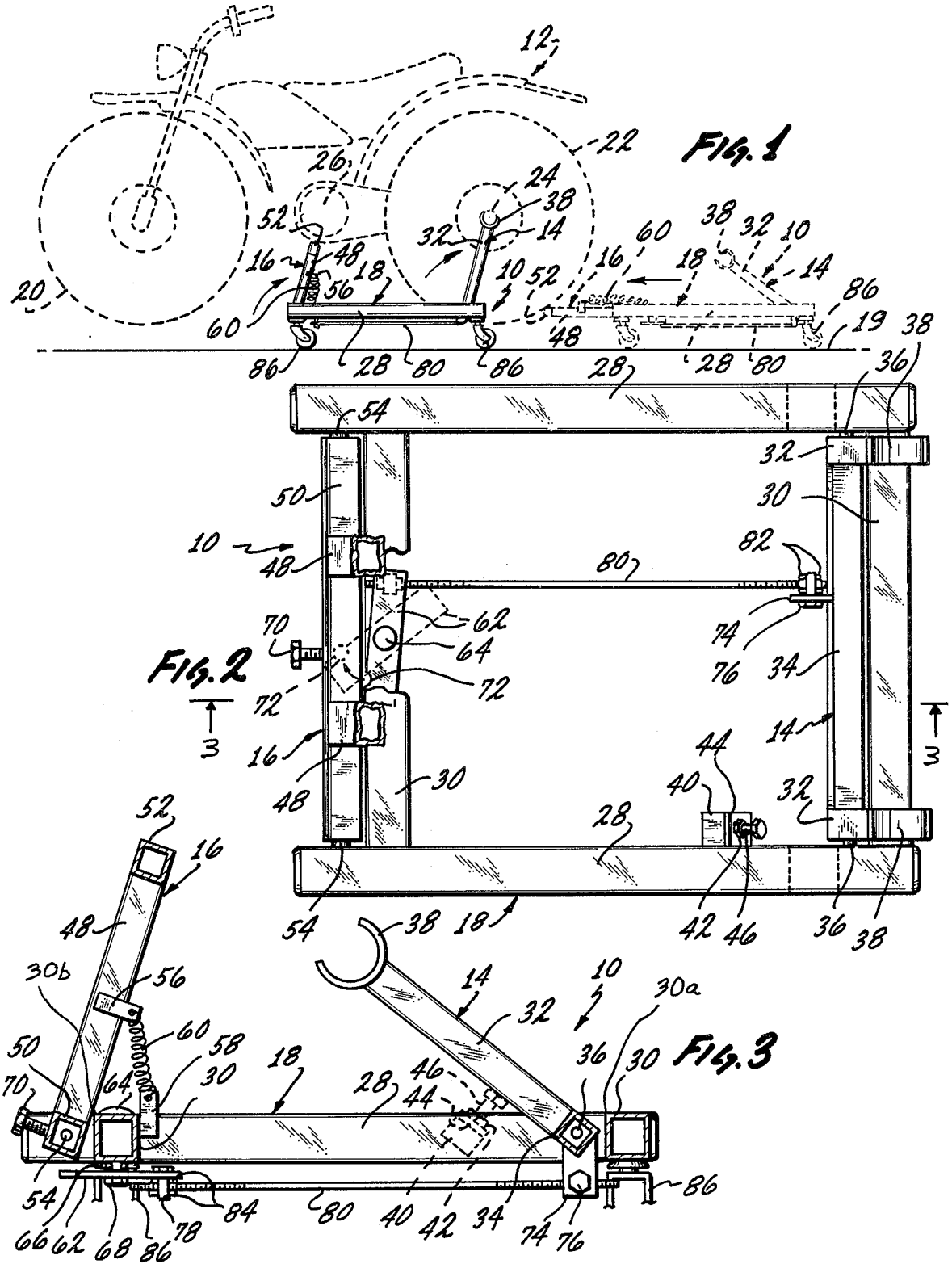
FIG. 1 is a side view illustrating the manner in which the preferred embodiment of the present invention may be utilized to raise a three wheeled vehicle to an elevated position.
FIG. 2 is an enlarged top plan view of the preferred embodiment of the servicing stand with portions broken away.
FIG. 3 is a sectional view of the preferred embodiment of the servicing stand taken along line 3—3 of FIG. 2.

Referring to FIG. 1, the servicing stand 10 of the present invention is designed to be rolled underneath a three wheeled vehicle 12 of the motorcycle type which is shown in phantom lines. The servicing stand includes rearward and forward brackets 14 and 16 which are pivotally mounted to the rearward and forward ends, respectively, of a horizontal base 18. When the forward and rearward brackets are in their retracted positions shown in phantom lines in FIG. 1, the base can be rolled forwardly along the ground 19 underneath the vehicle 12 from behind when the forward and rearward wheels 20 and 22 of the vehicle are resting on the ground. When the upper end of the rearward bracket engages the rear axle 24 of the vehicle, the forward bracket automatically swings up and engages the foot stand bar (not shown) adjacent the underside of the vehicle engine 26. Thereafter, a person can place his or her foot against the rearward end of the base 18 to hold the servicing stand 10 stationary while at the same time pulling rearwardly on the vehicle 12. This will cause the forward and rearward brackets 16 and 14 to fully swing to their extended positions shown in solid lines in FIG. 1. This raises the vehicle sufficiently so that its front and rear wheels are elevated off of the ground. Thereafter, the vehicle will remain balanced in the elevated position shown in FIG. 1 without further pulling on the vehicle to enable servicing of the vehicle.

Referring to FIG. 2, the base has a rectangular configuration and includes a pair of side beams 28 and a pair of cross beams 30. Preferably, these beams are hollow steel box beams which are welded together to form a very strong base. Preferably, the other structurable components of the servicing stand are also made of steel, however, other suitable materials may be substituted and various components may be rigidly connected in other ways besides welding.

The rearward bracket 14 has a generally U-shaped configuration and includes a pair of spaced apart arms 32 rigidly connected by a cross member 34. The cross member 34 is pivotally mounted to and extends between the side beams 28 just forward of the rearward cross beam 30. Pivot pins 36 extending outwardly from the lower ends of the arms 32 are received in corresponding holes in the inside walls of the rearward ends of the side beams 28. Thus, the rearward bracket 14 is mounted to the base 18 for pivotal movement with respect to the base. As best seen in FIG. 3, preferably the rearward bracket 14 is pivotally mounted to the side beams 28, a predetermined distance forward of the rearward cross beam 30 of the base. This distance is chosen so that when the rearward bracket is swung upwardly the arms 32 will engage the upper inner corner of 30*a* of the cross beam 30. This preferably occurs when the bracket 14 is in the position shown in FIG. 1. The fully extended position of the bracket 14 is slightly past verticle or over center. Thus, the load carried by the rearward bracket as it supports the rear axle 24 of the vehicle 12 prevents the bracket from swinging back through verticle to the retracted position shown in FIG. 3. When the vehicle has been raised to the elevated position shown in FIG. 1, it will stay in that position until a person moves the vehicle.

The upper ends of the arms 32 of the rearward bracket 14 each have C-shaped members 38 (FIGS. 2 and 3) rigidly secured thereto. They are specifically adapted for engaging and supporting the rear axle 24 as shown in FIG. 1.

An adjustable stop mechanism is provided for varying the retracted position of the rearward bracket 14. As shown in FIGS. 2 and 3, a rectangular housing 40 is secured to the inside wall of one of the side beams 28 at an inclined angle. A lock nut 42 is welded to the top plate 44 of the housing 40. The top plate has a hole aligned with the bore of the nut. A bolt 46 has its shank threadedly engaged with the nut 42. The head of the bolt 46 engages one of the arms 32 to limit the downward movement of the rearward bracket 14. The bolt 46 can be turned to adjust the retracted position of the rearward bracket 14. This permits the height of the C-shaped members 38 (FIG. 3) to be adjusted. When the bracket 14 is in its retracted position, the members 38 must be positioned to engage the axle 24 when the servicing stand 10 is rolled underneath the vehicle 12 from behind. The C-shaped members 38 engage the axle 24 at spaced apart locations adjacent the rear wheels 22.

The forward bracket 16 has a generally rectangular configuration including a pair of longitudinal legs 48 which are secured at their opposite ends to a pair of cross legs 50 and 52 (FIGS. 2 and 3). The forward bracket 16 is also pivotally mounted to the base 18 for swinging between a retracted position shown in phantom lines in FIG. 1 and an extended position shown in solid lines in FIG. 1. The cross leg 50 of the forward bracket 16 is pivotally mounted to and extends between the forward ends of the side beams 28 of the base. A pair of pivot pins 54 are rigidly secured to opposite ends of the cross legs 16 and are received in corresponding holes in the inner walls of the forward ends of the side beams 28.

Preferably, as best seen in FIG. 3, the cross leg 50 of the forward bracket 16 is pivotally mounted to the side beams 28 of the base a predetermined distance forward of the forward cross beams 30. This distances is chosen so that the forward bracket can swing upwardly through verticle to a fully extended position shown in FIGS. 1 and 3. In this position, the longitudinal legs 48 of the forward bracket abutt against an upper forward corner 30*b* of the forward cross beam 30. Thus, when the cross leg 52 at the upper end of the forward bracket is engaging and supporting the foot stand bar (not shown) adjacent the engine 26 as shown in FIG. 1, the load supported by the forward bracket will be off center when the bracket 16 is fully extended. When the vehicle 12 is in the elevated position shown in FIG. 1 with both the rearward and forward brackets fully extended, the load carried by the brackets is off center. The brackets will not swing forwardly through verticle to drop the vehicle back to the ground unless a person moves the vehicle upwardly and forwardly.

The servicing stand is constructed so that the forward support bracket will automatically swing upwardly into engagement with the underside of the vehicle when the rearward support bracket engages the rearward axle of the vehicle. Flanges 56 and 58 are secured to one of the longitudinal legs 48 of the forward bracket and to the forward cross beam 30 of the base as shown in FIG. 3. A suitable strength spring 60 has its opposite ends secured to respective ones of these flanges. The spring normally urges the forward bracket 60 toward its upright fully extended position shown in FIGS. 1 and 3. A latch 62 is rotatably mounted to the underside of the forward cross beam 30 midway of its length. A bolt 64 extends vertically through the forward cross beam 30 and through a hole in the center of the latch 62. An inner nut 66 secures the bolt 64 to the cross beam 30 of the base. An outer lock nut 68 retains the latch on the shank of the bolt 64. Sufficient clearance between the nuts 66 and 68 is provided so that the latch can freely pivot on the shank of the bolt 64. A bolt 70 (FIG. 3) has the end of its shank welded to the outer wall of the cross leg 50 of the forward bracket, midway of the length of the cross leg as shown in FIG. 3. The latch 62 has an arcuate groove 72 (FIG. 2) formed in its side edge at one end thereof.

When the forward bracket 16 is manually forced downwardly to its retracted position shown in phantom lines in FIG. 1, the latch 62 can be rotated to its locked position shown in phantom lines in FIG. 2. The shank of the bolt 70 will then be received in the groove 72 in the latch. In this position, the latch clamps the forward bracket in its retracted position. The latch can be rotated counter-clockwise in FIG. 2 to its unlocked position shown in solid lines to disengage from the bolt 70, thereby releasing the forward bracket 16 and permitting it to swing upwardly toward its extended position under the force of the spring 60.

A linkage mechanism is provided for connecting the rearward bracket 14 with the clamping mechanism. Movement of the rearward bracket away from its retracted position will operate the clamping mechanism to release the forward bracket so that it can swing upward until its cross leg 52 engages the underside of the vehicle. A flange 74 (FIGS. 2 and 3) is secured to the exterior of the cross member 34 of the rearward bracket, midway of the member as best seen in FIG. 3.

A bolt 76 extends through a hole in the remote end of the flange 74. A bolt 78 (FIG. 3) extends through the end of the latch 62 opposite from the groove 72 formed therein. A tie rod 80 has one end which extends through a hole bored through the shank of the bolt 76. The other end of the tie rod extends through a hole bored through the shank of the bolt 78. The opposite ends of the tie rod 80 are threaded. A pair of lock nuts 82 are threadedly engaged with the rearward end of the tie rod on either side of the shank of the bolt 76. Similarly, a pair of lock nuts 84 are threadedly engaged with the forward end of the tie rod 80 on either side of the shank of the bolt 78. By adjusting the nuts 82 and 84, the effective length of the linkage between the rearward bracket 14 and the clamp mechanism can be varied.

Where the servicing stand is to be utilized on a hard surface such as concrete or asphalt, wheels are preferably mounted on the servicing stand. This permits the vehicle 12 to be readily moved around in the work area by rolling the servicing stand while the vehicle is in its elevated position. As shown in FIG. 1, the wheels may take the form of a plurality of casters 86 which are mounted at the four corners of the base 18. Where the servicing stand is to be utilized on a dirt surface, preferably it is not provided with wheels or casters.

Having described the construction of the preferred embodiment of the servicing stand of the present invention, the manner in which it may be utilized will now become readily apparent. The user first cocks or pushes down the forward bracket 16 to its fully retracted position shown in phantom lines in FIG. 1 utilizing one of his or her hands. At the same time, the user pushes down the rearward bracket 14 with his or her other hand, causing the latch 62 to rotate to its locked position shown in phantom lines in FIG. 2. This clamps the forward bracket in its retracted position shown in phantom lines in FIG. 1.

The servicing stand 10 is next rolled underneath the parked three wheeled vehicle 12 (FIG. 1) whose forward and rearward wheels 20 and 22 are now resting on the ground 19. The servicing stand is rolled forwardly underneath the vehicle between its rear two wheels 22 as indicated by the arrow in FIG. 1. When the C-shaped members 38 engage the rear axle 24, continued forward pushing of the servicing stand or a slight pulling of the vehicle rearward with respect to the servicing stand will cause the rearward bracket 14 to start swinging upward. The upward swinging of the rearward bracket 14 causes the flange 74 (FIG. 3) to move forwardly. Thus, the tie rod 80 moves forwardly to rotate the latch 62 from its locked position shown in phantom lines in FIG. 2 to its unlocked position shown in solid lines in FIG. 2. The latch 62 is thus disengaged from the bolt 70 on the forward bracket. The now unclamped forward bracket swings upwardly under the force of the spring 60 until its upper cross leg 52 engages the underside of the vehicle 12.

The user now puts one of his or her feet against the rear of the base 18 to hold it stationary as he or she manually pulls the vehicle rearwardly. As the rearward and forward brackets 14 and 16 pivot upwardly past verticle to their fully extended positions shown in FIG. 1, the vehicle is sufficiently raised to elevate its front and rear wheels 20 and 22 off of the ground. Since the load carried by each of the forward and rearward brackets is over center, the user can then let go of the rear of the vehicle and the vehicle will remain balanced in its raised position. The vehicle can then be serviced and can be rolled around to different locations on the servicing stand. To lower the vehicle off of the servicing stand, the user need only hold the servicing stand stationary while pushing the vehicle forwardly so that the brackets swing away from their fully extended positions past verticle and the vehicle is let down onto the ground.

Having described a preferred embodiment of my servicing stand, it should be apparent to those skilled in the art that my invention can be modified in arrangement and detail. Therefore, my invention should be limited only in accordance with the scope of the following claims.

I claim:

1. A servicing stand for a three wheeled vehicle having two rear wheels mounted to opposite ends of an axle powered by an engine and a front wheel, comprising:

a horizontal base;

a rearward bracket having a pair of upper ends for engaging and supporting the axle at spaced apart locations adjacent the rear wheels;

means for pivotally mounting the rearward bracket to the rearward end of the base so that the rearward bracket can swing upwardly from a retracted position to an extended position;

a forward bracket having an upper end adapted to engage and support a portion of the vehicle adjacent the engine;

means for pivotally mounting the forward bracket to the forward end of the base so that the forward bracket can swing upwardly from a retracted position to an extended position;

means for urging the forward bracket towards its extended position;

releasable clamp means for retaining the forward bracket in its retracted position; and linkage means for connecting the rearward bracket with the clamp means so that movement of the rearward bracket away from its retracted position operates the clamp means to release the forward bracket so that the forward bracket can swing towards its extended position.

2. A servicing stand according to claim 1 wherein the distance between the positions on the base at which the forward and rearward brackets are pivotally mounted, the extended and retracted positions of the forward and rearward brackets, and the lengths of the brackets are such that when the forward and rearward brackets are in their retracted positions, the base can be moved forwardly along the ground underneath the vehicle from the rear of the vehicle when the vehicle is resting on the ground and the upper ends of the rearward bracket will engage the axle, and continued forward movement of the base relative to the vehicle will cause the rearward bracket to begin to swing toward its extended position to thereby cause the forward bracket to be released so that it will swing toward its extended position until its upper end engages the portion of the vehicle adjacent the engine, and thereafter rearward pulling of the vehicle relative to the base will cause the forward and rearward brackets to fully swing to their extended positions to thereby raise the vehicle sufficiently so that its front and rear wheels will be elevated off of the ground and the vehicle will thereafter remain balanced in the raised position without further pulling on the vehicle.

3. A servicing stand according to claim 1 and further comprising adjustable stop means for varying the retracted position of the rearward bracket.

4. A servicing stand according to claim 1 wherein the upper ends of the rearward bracket comprise C-shaped members for receiving and supporting the rearward axle.

5. A servicing stand according to claim 1 and further comprising a plurality of wheels and means for rotatably mounting the wheels to the base so that the base can be rolled along the ground.

6. A servicing stand according to claim 1 wherein the means for urging the forward bracket toward its extended position includes a spring connected between the forward bracket and the base.

7. A servicing stand according to claim 1 wherein the releasable clamp means includes:

a latch; and means for rotatably mounting the latch to the base so that it can move from a locked position in which it engages and holds the forward bracket to an unlocked position in which it is clear of the forward bracket.

8. A servicing stand according to claim 1 wherein the linkage means includes:

a rod extending between the lower end of the rearward bracket and the clamp means; and adjustable connecting means for connecting the rearward end of the rod to the lower end of the rearward bracket and for connecting the forward end of the rod to the clamp means so that the effective length of the linkage between the rearward bracket and the clamp means can be varied.

9. A servicing stand according to claim 1 wherein the base comprises a rectangular frame having two side beams and two cross beams, the rearward bracket has a generally U-shaped configuration including a pair of spaced apart arms and a cross member which is pivotally mounted to and extends between the side beams of the frame, and wherein the forward bracket has a generally rectangular configuration and has one leg pivotally mounted to and extending between the side beams of the base, and further wherein the forward and rearward brackets are pivotally mounted to the base so that when they are in their extended positions they rest against corresponding ones of the cross beams of the base to hold the vehicle in its raised position.

10. A servicing stand according to claim 1 wherein the releasable clamp means includes:

a bolt secured to the lower end of the forward bracket;

a latch having a groove therein for receiving the bolt; and means for rotatably mounting the latch to the base so that when the forward bracket is in its retracted position the latch can rotate to a locked position in which the bolt is received in the groove of the latch to an unlocked position in which the bolt is clear of the latch.

* * * * *